US012623810B2

(12) United States Patent
Woch et al.

(10) Patent No.: US 12,623,810 B2
(45) Date of Patent: May 12, 2026

(54) PLASTIC PALLET

(71) Applicant: MOTHERSON INNOVATIONS COMPANY LIMITED, London (GB)

(72) Inventors: Holger Woch, Gundelfingen (DE); Marco Schuler, Freiburg (DE); Ulrich Erb, Forchheim (DE)

(73) Assignee: Motherson Innovations Company Limited, London (GB)

( * ) Notice: Subject to any disclaimer, the term of this patent is extended or adjusted under 35 U.S.C. 154(b) by 183 days.

(21) Appl. No.: 18/227,196

(22) Filed: Jul. 27, 2023

(65) Prior Publication Data

US 2024/0034511 A1 Feb. 1, 2024

(30) Foreign Application Priority Data

Jul. 29, 2022 (EP) ..... 22187931

(51) Int. Cl.
*B65D 19/00* (2006.01)

(52) U.S. Cl.
CPC ..... *B65D 19/0018* (2013.01); *B65D 2519/00034* (2013.01); *B65D 2519/00069* (2013.01); *B65D 2519/00268* (2013.01); *B65D 2519/00308* (2013.01)

(58) Field of Classification Search
CPC ..... B65D 19/0018; B65D 19/00034; B65D 19/00069; B65D 19/00268; B65D 19/00308
USPC ..... 108/57.25
See application file for complete search history.

(56) References Cited

U.S. PATENT DOCUMENTS 1,770,614 A * 7/1930 Hennessy ..... B65D 19/0075 108/57.25
3,664,271 A * 5/1972 Wolder ..... B65D 19/0012 108/57.1
3,702,100 A * 11/1972 Wharton ..... B65D 19/0038 108/901
3,720,176 A * 3/1973 Munroe ..... B65D 19/0051 108/57.25

(Continued)

FOREIGN PATENT DOCUMENTS

CN 204056571 U 12/2014
CN 104736445 A 6/2015

(Continued)

OTHER PUBLICATIONS

European Search Report issued by the European Patent Office in 22 187931.5 issued on Jan. 16, 2023.

(Continued)

*Primary Examiner* — Jose V Chen
(74) *Attorney, Agent, or Firm* — Ursula B. Day, Esq.

(57) ABSTRACT

The present disclosure refers to a pallet made of plastics that includes a pallet body and a plurality of support feet, the pallet body having a length (l), a width (w) and a height (h1), the height (h1) extending between an imaginary lower plane (p2) and an imaginary upper plane (p1), wherein the pallet body comprises several body parts being arranged alternately in the upper plane (p1) and the lower plane (p2) along the direction of the width (w), thereby forming grooves extending in the direction of the length (l), wherein at least in one of the grooves several ribs extending in direction of the width (w) are arranged.

14 Claims, 8 Drawing Sheets

(56) References Cited

U.S. PATENT DOCUMENTS 3,762,342 A * 10/1973 Lawlor ..... B65D 19/0018 108/901
4,413,737 A * 11/1983 Wind ..... B65D 19/004 217/43 A
4,507,348 A * 3/1985 Nagata ..... B65D 65/403 428/192
RE32,344 E * 2/1987 Wind ..... B65D 19/06 217/43 A
5,408,937 A 4/1995 Knight et al.
5,429,236 A * 7/1995 Evans ..... B65D 81/261 220/571
5,615,608 A * 4/1997 Shaw ..... B65D 19/0018 108/55.3
5,791,262 A * 8/1998 Knight ..... B65D 19/0012 108/57.25
5,794,544 A * 8/1998 Shuert ..... B65D 19/0012 108/57.25
5,829,595 A * 11/1998 Brown ..... B65D 19/0018 206/386
6,305,301 B1 * 10/2001 Piper, Jr. ..... B65D 19/0048 108/57.25
6,357,366 B1 * 3/2002 Frankenberg ..... B65D 19/0026 108/57.25
6,386,118 B1 * 5/2002 Bendit ..... B65D 19/0016 108/57.25
6,389,989 B1 * 5/2002 Hagerty ..... B65D 71/0096 108/57.25
6,745,703 B2 * 6/2004 Torrey ..... B65D 19/0012 108/51.11
6,805,061 B2 * 10/2004 Smyers ..... B65D 19/0012 108/57.25
7,275,489 B1 * 10/2007 Shuert ..... B65D 19/0018 108/57.25
8,651,028 B2 * 2/2014 Storteboom ..... B65D 19/0095 108/57.25
8,770,115 B2 * 7/2014 Apps ..... B65D 19/0004 108/57.25
8,776,698 B2 * 7/2014 Pherson ..... B65D 19/0004 108/57.25
11,560,256 B2 * 1/2023 Shawaf ..... B65D 19/0016
2003/0061974 A1 * 4/2003 Smyers ..... B65D 19/0012 108/57.33
2004/0134390 A1 * 7/2004 Apps ..... B65D 19/38 108/53.1
2004/0255828 A1 * 12/2004 Markling ..... B65D 19/0018 108/57.25
2005/0237184 A1 * 10/2005 Muirhead ..... B29C 66/54 108/57.25
2006/0185565 A1 * 8/2006 Brochu ..... B65D 19/0059 108/57.25
2007/0131148 A1 * 6/2007 Wu ..... B65D 19/0018 108/57.25
2007/0181045 A1 * 8/2007 Smyers ..... B65D 19/0028 108/53.3
2008/0053342 A1 * 3/2008 Muirhead ..... B65D 19/0012 108/57.25
2010/0251941 A1 * 10/2010 Muirhead ..... G06F 21/554 108/51.11
2011/0179978 A1 * 7/2011 Schmitt ..... B65D 19/0036 108/51.11
2013/0032507 A1 * 2/2013 Du Toit ..... B65D 19/0012 206/599
2015/0001114 A1 * 1/2015 Kelly ..... B65D 71/70 206/386
2021/0261294 A1 8/2021 Gabrys et al.
2024/0034511 A1 * 2/2024 Woch ..... B65D 19/0018

FOREIGN PATENT DOCUMENTS

| | | | |
|---|---|---|---|
| CN | 114258376 | A | 3/2022 |
| DE | 100 43 915 | A1 | 3/2002 |
| EP | 2 487 117 | A1 | 8/2012 |
| GB | 2271336 | A | 4/1994 |
| JP | H05 75126 | U | 10/1993 |
| JP | 200307827 | A | 3/2003 |
| JP | 2019 210006 | A | 12/2019 |

OTHER PUBLICATIONS

Translation of Chinese Search Report issued by the Chinese Patent Office in 202310749640.1 issued on Jul. 12, 2025.

* cited by examiner

PLASTIC PALLET

CROSS-REFERENCES TO RELATED APPLICATIONS

This application claims the priority of European Patent Application Serial No. EP22187931.5 filed Jul. 29, 2022, pursuant to 35 U.S.C. 119(a)-(d), the subject matter of which is incorporated herein by reference.

BACKGROUND OF THE INVENTION

The present disclosure refers to a pallet especially for use in logistics, for example for storing and transport of containers.

For the storage and transfer of goods it is well-known to use pallets comprising a pallet body and a plurality of support feet. Containers comprising the goods can be placed on the pallets. The pallets can be transferred for example using a forklift. Therefore, the pallets usually have standardized dimensions regarding length and width. Furthermore, the support feet usually are arranged at the pallet body in such a way that the forklift can place the forks between the feet to lift the pallet. Different types of pallets are shown in DE 10 2015 215 098 A1, WO 2021/181266 A1, US 2011 0132801 A1, EP 3 354 586 B1, U.S. Pat. No. 5,769,003 A, WO 2006/130191 A1, EP 3 592 653 A1, DE 10 2009 038 963 B4 and DE 10 2012 221 843 A1.

The pallets have to be designed to be able to carry specific loads. It is known to produce pallets using wood or plastics. If made of plastics, underneath the feet skids are arranged to achieve the necessary stiffness.

Further, it is desirable that the pallets are suitable for storage in a high rack storage area in which they are placed on two tracks being arranged in parallel and supporting the pallet at two edges being arranged opposite only.

For pallets suitable for storage in a high rack storage area it is known to include metal parts to achieve the necessary stiffness. This involves use of additional materials and process to achieve the desired result which takes time and is expensive. It is one task of one embodiment of the present disclosure to propose a pellet made of plastics being suitable for use in a high rack storage area.

It would therefore be desirable and advantageous to provide an improved pallet to obviate prior art shortcomings and to provide a pallet made of plastics being suitable for use in high rack storage area that fulfills desired characteristics and features as set forth below.

SUMMARY OF THE INVENTION

According to one aspect of the present invention, a pallet is disclosed, which includes a pallet body and a plurality of support feet, the pallet body having a length, a width and a height, the height extending between an imaginary lower plane and an imaginary upper plane, wherein the pallet body compasses several body parts being arranged alternately in the upper plane and the lower plane along the direction of the width, thereby forming grooves extending in the direction of the length, wherein at least in one of the grooves several ribs extending in direction of the width are arranged.

Further advantageous embodiments are subject to the dependent claims.

According to an embodiment of the present disclosure, a pallet made of plastics comprises a pallet body and a plurality of support feet, the pallet body having a length, a width and a height, the height extending between an imaginary lower plane and an imaginary upper plane, wherein the pallet body comprises several body parts being arranged alternately in the upper plane and the lower plane along the direction of the width, thereby forming grooves extending in the direction of the length, wherein at least in one of the grooves several ribs extending in direction of the width are arranged.

Body parts being arranged alternately in the upper plane and the lower plane along the direction of the width, thereby forming grooves extending in the direction of the length, with other words provide a pallet body having at least one cross section parallel to the width of the pallet body comprising the form of a square signal. In such a structure, the grooves open alternately to the upper plane and the lower plane along the direction of the width. Such a structure can provide a light weight but stiff structure, especially when bending in direction of the length. The arrangement of several ribs extending in direction of the width in at least one of the grooves provides rigidity when bending in direction of the width.

The specific structure of the pallet enables to provide a pallet being made of plastics without the necessity of including further supporting or reinforcing metal elements. The pallet can be produced of plastics in its entirety. Further, the specific structure of the pallet enables to provide a pallet being made of plastics without the necessity of providing skids underneath the support feet and therefore a pallet being made of plastics being suitable for use in a high rack storage area.

According to one embodiment, in all of the grooves being open in the upper plane and/or all of the grooves being open in the lower plane several ribs extending in direction of the width are arranged, especially to enhance rigidity.

According to a further preferred embodiment, the grooves extend between the support feet or over the entire length of the pallet body, to provide the rigidity enhancing structure to the most possible extent of the pallet body.

According to a preferred embodiment, the length is longer that the width. As a result, the grooves extend in the longer direction and, in case the pallet is used in a high rack storage area, in direction of curvature, thereby providing higher rigidity in this direction.

According to a further embodiment, the support feet are protruding from the lower plane and are extending through the pallet body up to the upper plane. In case the support feet extend through the pallet body the rigidity can be further enhanced.

According to a preferred embodiment, each of the support feet comprises an outer tube and at least one inner tube especially extending over the entire height of the support feet, the inner tube being arranged within the outer tube and being connected to the outer tube via connecting ribs. This structure of a support foot was found to provide high stability.

Preferably, outer tube has a rectangular cross section and the at least one inner tube has a circular cross section which can enhance the stability further.

According to an embodiment, the pallet body comprises a circumferential rim projecting above the upper plane. Such a rim on the one hand can enhance stiffness of the pallet body. On the other hand, such a rim can provide a limit stop for the goods or containers placed on the pallet body.

To enhance rigidity further, the rim can comprise at least in sections a wave-like-structure.

According to a preferred embodiment, a channel is arranged between the pallet body and the circumferential rim, the channel being open to the upper plane and preferably extending from the lower plane to the upper plane. It is possible to position a pallet wall or pallet ring in this channel to build a box-like structure for transport of goods.

To enable better fastening of the pallet wall or pallet ring, according to a further embodiment at least one locking projection is arranged within the channel, preferably four, six or eight locking projections are arranged within the channel.

According to further embodiment, an inner rim is arranged between the pallet body and the channel extending over at least part of the circumference of the pallet body, preferably extending at least around the corners of the pallet body. Such an inner rim can provide a limit stop for the goods or containers placed on the pallet body. Especially, the relative arrangement of the channel and the inner rim can be chosen in such a way that both the pallet wall or pallet ring and standardized containers can be fastened on the pallet.

According to a further embodiment, the circumferential rim, the upper side of the pallet body and the lower side of the pallet body comprise recesses. Such recesses enable positioning of fastening belts thereby reducing the risk of damaging the fastening belts.

According to a preferred embodiment, the pallet is produced by injection-molding. Injection-molding allows a cost-effective production of the pallet.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
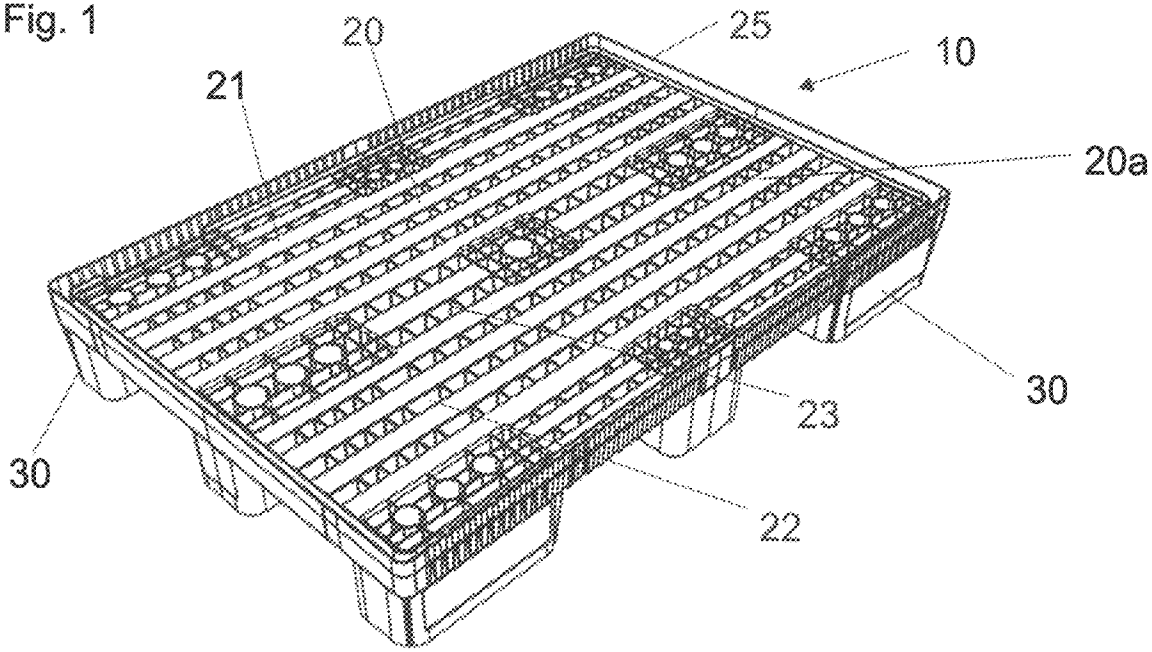
FIG. 1 is a perspective view of a pallet according to an embodiment of the present disclosure.

Throughout all the Figures, same or corresponding elements are generally indicated by same reference numerals. For better overview, not all reference numbers are included in all figures.

Turning now to the drawing, and in particular to FIG. 1, there is shown a pallet 10 made of plastics that can be produced by injection-molding.

Figure 2:
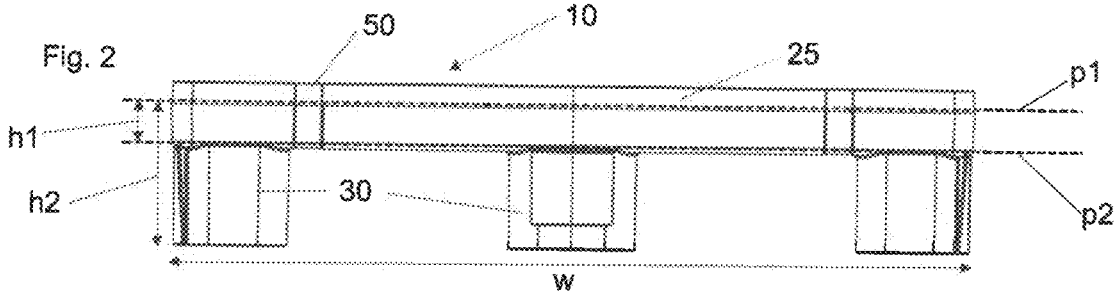
FIG. 2 is a side view looking in direction of the length of the pallet according to FIG. 1.
Figure 3:
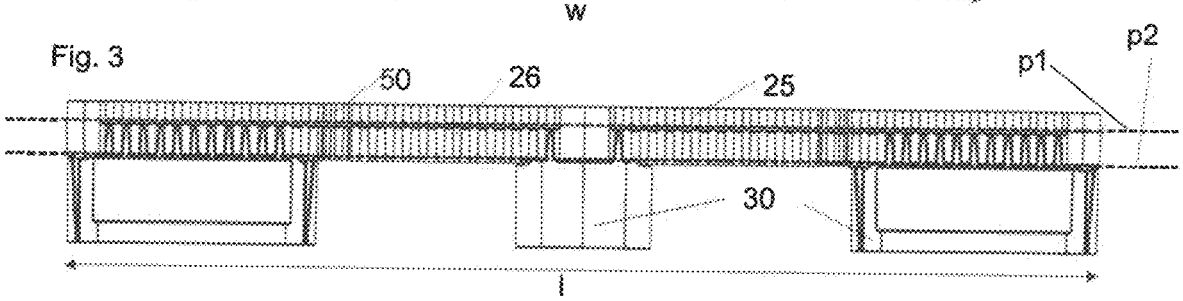
FIG. 3 is a side view looking in direction of the width of the pallet according to FIG. 1.

The pallet 10 comprises a pallet body 20 and a plurality of support feet 30. The pallet body 10 has a length l, a width w and a height h1, the height h1 extending between an imaginary lower plane p2 and an imaginary upper plane p1 (see FIGS. 2 and 3). In an embodiment, the lower plane p2 and the upper plane p1 are arranged parallel to each other. Especially, an upper side 20*a* of the pallet body 20 lies against the upper plane p1 and a lower side 20*b* of the pallet body 20 lies against the lower plane p2. The length l of the embodiment of the pallet 10 shown in the figures is longer that the width w.

Figure 12:
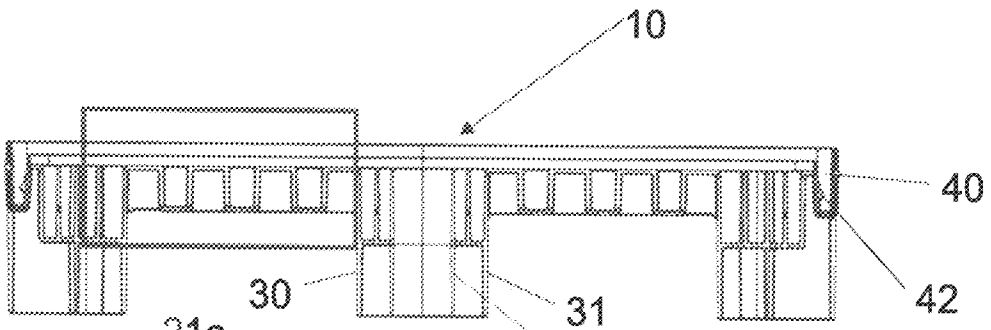
FIG. 12 is a sectional view along line A-A in FIG. 10 of the pallet according to FIG. 1.

The pallet body 20 comprises several body parts 21. The body parts 21 may be shaped as rectangular body parts 21. The body parts 21 are arranged alternately in the upper plane p1 and the lower plane p2 along the direction of the width w (see especially FIGS. 12 and 13), thereby forming grooves 22 extending in the direction of the length l. In the figures, body parts 21 being arranged in the upper plane p1 are labeled with 21*a* in addition, and body parts 21 being arranged in the lower plane p2 are labeled with 21*b* in addition. The body parts 21*a* arranged in the upper plane p1 and the body parts 21*b* arranged in the lower plane p2 are connected by side walls 22*c*. In other words, as can best be seen in FIG. 13, the pallet body 20 has at least one cross section parallel to the width w of the pallet body 20 comprising the form of a square signal, the square signal especially being formed by the body parts 21*a* being arranged in the upper plane p1, the body parts 21*b* being arranged in the lower plane p2 and the side walls 21*c*.

In such a structure, the grooves 22 open alternately to the upper plane p1 and the lower plane p2 along the direction of the width w. In the figures, grooves 22 being open in the upper plane p1 are labeled with 22*a* in addition, and grooves 22 being open in the lower plane p2 are labeled with 22*b* in addition.

The grooves 22 can extend between the support feet 30 or over the entire length l of the pallet body 20.

Figure 8:
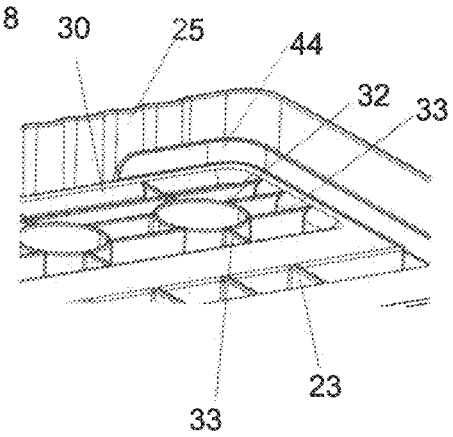
FIG. 8 is a part of an enlarged perspective view of the pallet according to FIG. 1 illustrating a part of an inner rim.
Figure 9:
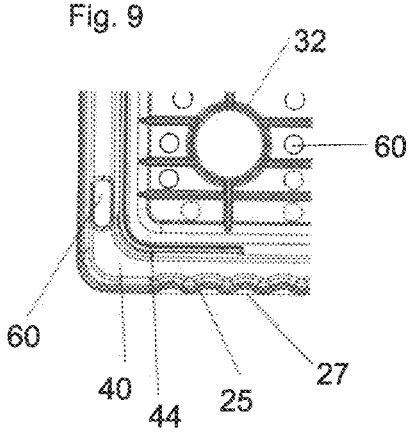
FIG. 9 is a top view of the view according to FIG. 8.

At least in one of the grooves 22 several ribs 23 extending in direction of the width w are arranged (see especially FIGS. 1 and 8). In the embodiment of the pallet 10 illustrated in the figures, in all of the grooves 22*a* being open in the upper plane p1 (see FIGS. 1 and 4) and in all of the grooves 22*b* being open in the lower plane p2 (see FIG. 5) several ribs 23 extending in direction of the width w are arranged. The ribs 23 can be evenly distributed along grooves 22. Especially, for all of the grooves 22 the ribs 23 are placed at same positions of the length (see especially FIG. 1). The ribs 23 preferably extend from the bottom of the groove 22 to the top of the groove or in other words from the lower plane p2 to the upper plane p1.

The support feet 30 are protruding from the lower plane p2. Further, the support feet 30 can extend through the pallet body 20 up to the upper plane p1. Each of the support feet 30 may comprise an outer tube 31 and at least one inner tube 32 especially extending over the entire height h2 of the support feet 30, the inner tube 32 being arranged within the outer tube 31 and being connected to the outer tube 31 via connecting ribs 33. The connecting ribs 33 preferably extend either parallel to the direction of the length l or parallel to the direction of the width w. According to an embodiment, the connecting ribs 33 extending parallel to the direction of the width w are in line with at least one of the ribs 23 arranged in the grooves 22. Further, according to an embodiment, the connecting ribs 33 extending parallel to the direction of the length are in line with at least one of the side walls 21*c*.

The embodiment of the pallet 10 as shown in the figures comprises nine support feet 30. Especially in each of the corners of the pallet body 20, one support feet 30 is arranged. Further, the support feet 30 can be arranged in lines of three support feet 30, both in direction of the length l and the width w.

Some of the support feet 30, preferably at least the support feet 30 arranged in the corners of the pallet body 20, more preferably the support feet 30 arranged along the shorter lateral edges of the pallet body 20, can comprise three inner tubes 32. In an embodiment, the support feet 30 arranged in the middle of the longer lateral edge of the pallet body 20 can comprise two inner tubes 32. It may be possible that only the support foot arranged in the center of the pallet body 20 comprises only one inner tube 32.

The outer tube 31 of the support feet 30 may have a rectangular cross section and the at least one inner tube 32 of the support feet 30 may have a circular cross section.

Figure 13:
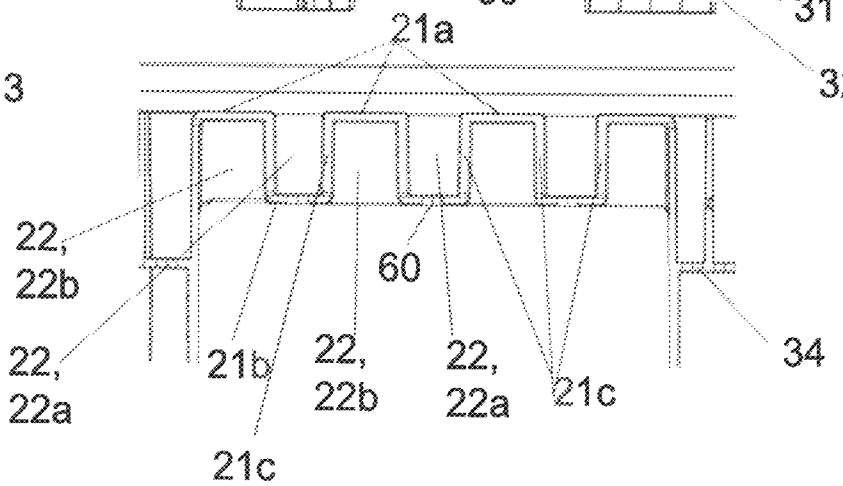
FIG. 13 is an enlarged view of the sectional view according to FIG. 12.

Each of the support feet 30 may have a reinforcing floor part 34 being between the inner tube 32 and the outer tube 31 and extending parallel to the upper plane p1 and the lower plane p2, especially at half height (see especially FIG. 13).

Figure 6:
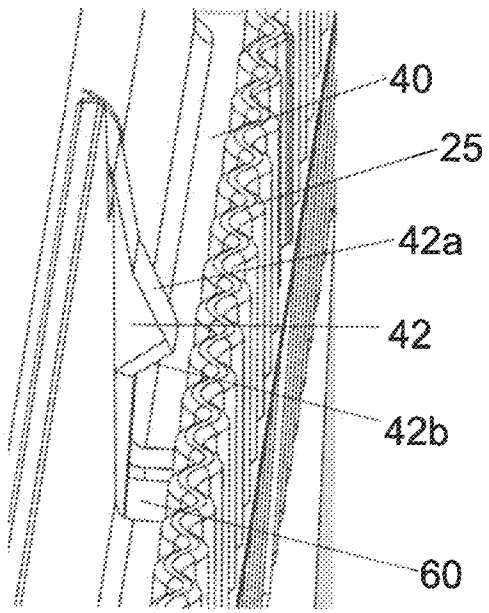
FIG. 6 is a perspective view of a locking projection in which is illustrated that the locking projection 42 protrudes in the channel 40, approximately at half height of the channel.

The pallet body 20 can be surrounded by a circumferential rim 25 projecting above the upper plane p1 (see for example FIGS. 1 and 8). The circumferential rim 25 may comprise at least in sections a wave-like-structure 26 (see for example FIGS. 1 and 6). Further, to enhance rigidity, the circumferential rim 25 might comprise a circumferential brim 27 extending outward from the circumferential rim 25, especially parallel to the upper plane p1 and the lower plane p2, for example at half height of the circumferential rim 25.

Figure 7:
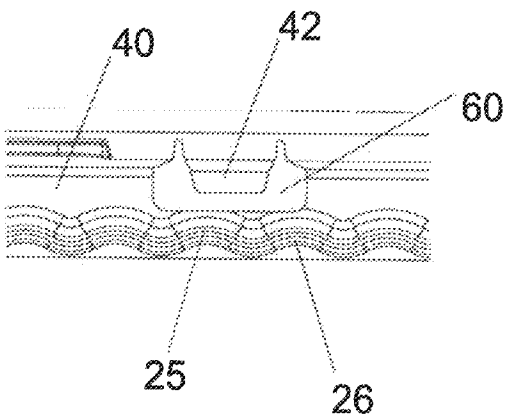
FIG. 7 is a detail of a top view showing the locking projection 42.

A channel 40 may be arranged between the pallet body 20 and the circumferential rim 25, the channel 40 being open to the upper plane p1 and preferably extending from the lower plane p2 to the upper plane p1. As can be seen for example in FIGS. 6 and 7, at least one locking projection 42 can be arranged within the channel 40. The locking projection 42 may be formed as a wedge with at least a first slope 42*a* being arranged from the circumferential rim 25 protruding into the channel 40. Preferably, the locking projection 42 may comprise a second slope 42*b* being arranged in opposite direction than the first slope 42*a*. Such a second slope 42*b* may facilitate release of a pallet wall or pallet ring (not shown). In an embodiment, four (see FIG. 4), six or eight locking projections 42 may be arranged within the channel 40.

An inner rim 44 may be arranged between the pallet body 20 and the channel 40 extending over at least part of the circumference of the pallet body 20, preferably extending at least around the corners of the pallet body 20. The inner rim protrudes above the upper plane p1, preferably less than the circumferential rim 25, especially less than half height of the circumferential rim 25.

The circumferential rim 25, the upper side 20*a* of the pallet body 20 and the lower side 20*b* of the pallet body 20 may comprise recesses 50. The recesses 50 are suitable for positioning fastening belts (not shown).

Figure 4:
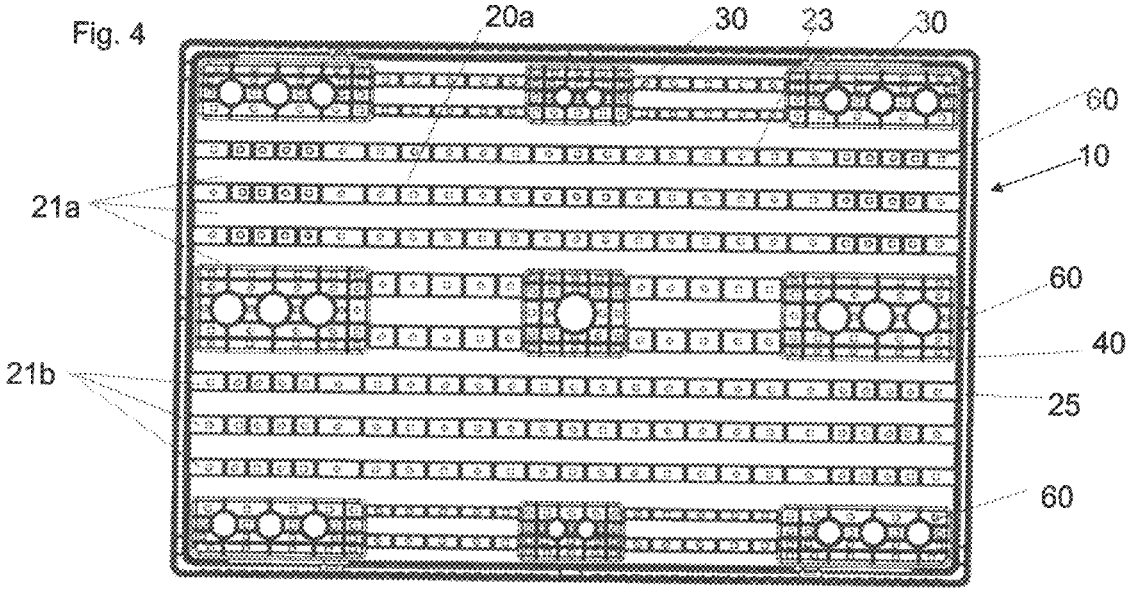
FIG. 4 is a top view of the pallet according to FIG. 1.
Figure 5:
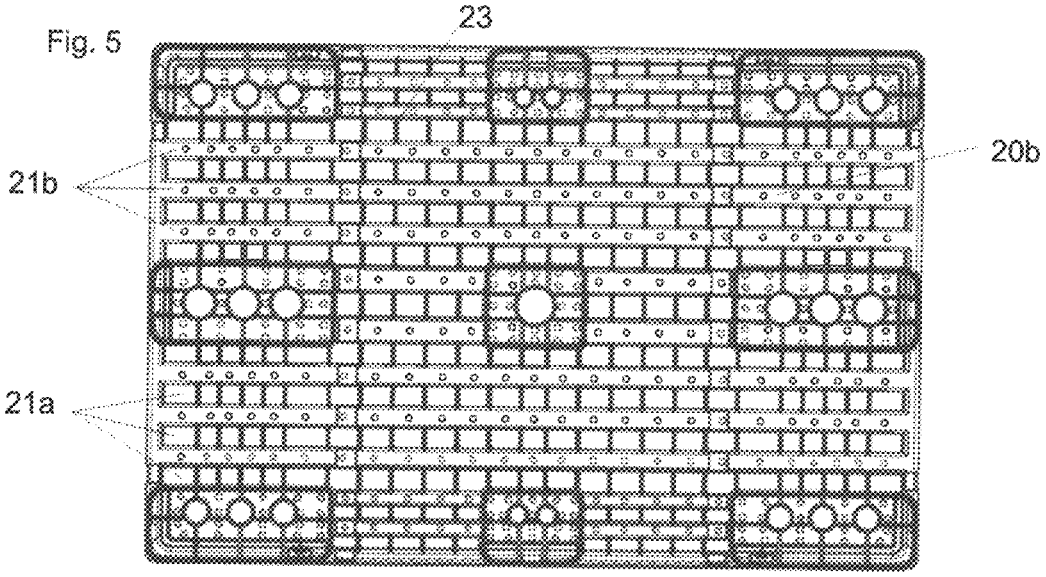
FIG. 5 is a bottom view of the pallet according to FIG. 1.

To enable water flow from the pallet 20, holes 60 can be provided, for example in the body parts 21*b* arranged in the lower plane p2 and/or the channel 40 and/or the reinforcing floor elements 34 (see for example FIG. 4).

Figure 10:
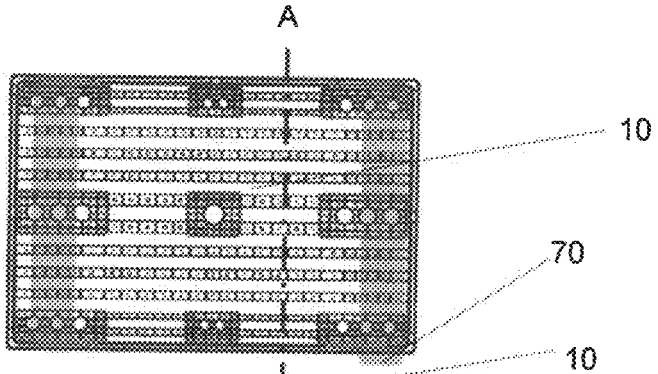
FIG. 10 is a top view of the pallet according to FIG. 1 including by means of a principle illustration two tracks of a high rack storage area.
Figure 11:
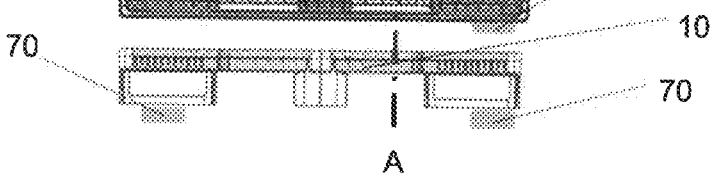
FIG. 11 is a side view of the pallet with two tracks of a high rack storage area according to FIG. 10.

The pallet 10 especially is for use in logistics, for example for storing and transport of containers. It is possible to fasten a pallet wall or pallet ring in the channel 40 surrounding the pallet body 20. Further, it is possible to place containers on the pallet 10 which can be secured against lateral movement by the inner rim 44. FIGS. 10 and 11 illustrate the pallet 10 being placed on two tracks 70 being part of a high rack storage area (not shown).

While the invention has been illustrated and described as embodied in a pallet, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A pallet made of plastics comprising, a pallet body and a plurality of support feet, the pallet body having a length (l), a width (w) and a height (h1), the height (h1) extending between an imaginary lower plane (p2) and an imaginary upper plane (p1), wherein the pallet body comprises several body parts being arranged alternately in the upper plane (p1) and the lower plane (p2) along the direction of the width (w), thereby forming grooves extending in the direction of the length (l) wherein at least in one of the grooves several ribs extending in direction of the width (w) are arranged, a circumferential rim projecting above the upper plane (p1), wherein a channel is arranged between the pallet body and the circumferential rim, the channel being open to the upper plane (p1) and extending from the lower plane (p2) to the upper plane (p1), and wherein at least one locking projection protrudes in the channel for fastening a pallet wall or a pallet ring.

2. The pallet according to claim 1, wherein in all of the grooves being open in the upper plane (p1) and/or all of the grooves being open in the lower plane (p2) several ribs extending in direction of the width (w) are arranged.

3. The pallet according to claim 1, wherein the grooves extend between the support feet or over the entire length (l) of the pallet body.

4. The pallet according to claim 1, wherein the length (l) is longer that the width (w).

5. The pallet according to claim 1, wherein the support feet are protruding from the lower plane (p2) and are extending through the pallet body up to the upper plane (p1).

6. The pallet according to claim 1, wherein each of the support feet comprises an outer tube and at least one inner tube especially extending over the entire height (h2) of the support feet, the inner tube being arranged within the outer tube and being connected to the outer tube via connecting ribs.

7. The pallet according to claim 6, wherein the outer tube has a rectangular cross section and the at least one inner tube has a circular cross section.

8. The pallet according to claim 1, wherein the circumferential rim comprises at least in sections a wave-like-structure.

9. The pallet according to claim 1, further comprising an inner rim arranged between the pallet body and the channel extending over at least part of the circumference of the pallet body.

10. The pallet according to claim 9, wherein the inner rim extends at least around the corners of the pallet body.

11. The pallet according to claim 1, wherein the circumferential rim, the upper side of the pallet body and the lower side of the pallet body comprise recesses.

12. The pallet according to claim 1, wherein the pallet is injection-molded.

13. The pallet according to claim 1, wherein multiple locking projections are arranged within the channel.

14. The pallet according to claim 13, wherein the locking projections are increased in multiples of 2.

* * * * *